United States Patent [19]

Speiser et al.

[11] 4,191,367

[45] Mar. 4, 1980

[54] FLUID-OPERATED VISE WITH JAW MOUNTING SYSTEM

[76] Inventors: Arthur S. Speiser, 4400 Clarkwood Pkwy., Warrensville Hts., Ohio 44128; Samuel G. Sheterom, Jr., 25 Wintergreen Hill, Painesville, Ohio 44077

[21] Appl. No.: 914,157

[22] Filed: Jun. 13, 1978

Related U.S. Application Data

[63] Continuation-in-part of Ser. No. 851,839, Nov. 16, 1977, Pat. No. 4,101,119.

[51] Int. Cl.[2] ..... B25B 1/02

[52] U.S. Cl. ..... 269/203; 269/283; 308/3 A

[58] Field of Search ..... 269/35, 203, 205, 250, 269/257, 285, 271, 321 MP, 279, 280, 283; 308/3 A

[56] References Cited

U.S. PATENT DOCUMENTS

| | | | |
|---|---|---|---|
| 1,195,339 | 8/1916 | Codding et al. | 269/283 |
| 1,579,582 | 4/1926 | Voltz | 269/283 |
| 1,883,335 | 10/1932 | Braden | 269/283 |
| 3,002,726 | 10/1961 | Ford | 269/283 |
| 3,767,183 | 10/1973 | Gelder | 269/283 |

*Primary Examiner*—Robert C. Watson
*Attorney, Agent, or Firm*—Burge & Porter, Co.

[57] ABSTRACT

Vise jaws are mounted on supporting jaw structures by interfitting dovetail formations which taper to draw the jaws into tight-fitting engagement with their supporting jaw structures while also serving to accurately position and orient the jaws relative to their supporting jaw structures. The jaw mounting system utilizing these interfitting dovetail formations is particularly well adapted for use on a fluid-operated vise of a modular type. The preferred vise construction includes an elongate base structure having a generally rectangular top surface with an elongate undercut groove formed in the base structure and opening through the top surface. The jaw structures are supported on the top surface and are movably positionable therealong. In preferred practice, one of the jaw structures includes a fluid-operated movable component. This component and the other jaw structures are each provided with a jaw mounting surface. The jaw mounting surfaces face toward each other and the jaws are each mounted on a separate one of the mounting surfaces. In preferred practice, downwardly facing elongate grooves are formed in bottom portions of the jaw structures and communicate along their lengths with the undercut groove. Elongate key members are positioned in the communicating grooves to maintain proper alignment of the base and jaw structures. The key members also form parts of clamping systems which are operable to releasably retain the jaw structures in place at selected positions along the length of the top surface.

13 Claims, 8 Drawing Figures

FLUID-OPERATED VISE WITH JAW MOUNTING SYSTEM

CROSS-REFERENCE TO RELATED APPLICATIONS

The present application is a continuation-in-part of application Ser. No. 851,839 filed Nov. 16, 1977, now U.S. Pat. No. 4,101,119, entitled FLUID-OPERATED VISE, hereafter the "Hydraulic Vise Patent."

Reference is also made to Design Patent Application Ser. No. 851,840 filed concurrently with the Hydraulic Vise Patent.

BACKGROUND OF THE INVENTION

1. Field of the Invention

The present invention relates to a system for removably mounting and accurately positioning jaws on supporting jaw structures of a vise, and is particularly well adapted for use on a modular fluid-operated vise of the type described in the referenced Hydraulic Vise Patent.

2. Prior Art

While proposals have been made to incorporate fluid-operated actuators in vise units, these proposals have typically suffered a number of drawbacks. Most proposals have resulted in relatively complex constructions which do not facilitate end-to-end and/or side-by-side positioning of a plurality of vise units. Essentially non-modular jaw and base structures have been utilized, with the result that these structures cannot be positioned relative to each other in sufficiently versatile arrangements and configurations to serve a wide variety of production needs.

Another common problem with many vise proposals is that their relatively movable jaw and base structures are not provided with adequate systems for assuring constant and accurate relative alignment of the jaw and base structures. Where adequate alignment systems have been employed, these systems have not been well adapted for use with modular jaw and base structure components.

The foregoing and other drawbacks of the prior art are addressed and overcome by the vise system described in the referenced Hydraulic Vise Patent. In accordance with the system of the Hydraulic Vise Patent, a pair of jaws are mounted on relatively movable jaw structures. Inasmuch as the jaws are ordinarily specially configured to serve the needs of a particular application, the Hydraulic Vise Patent does not address itself to any particular jaw configurations.

Neither does the Hydraulic Vise Patent address the problem of providing a simple and inexpensive jaw mounting system which will serve the dual functions of removably mounting and simultaneously accurately positioning jaws on the jaw structures. With prior vise proposals, vise jaws are ordinarily held in place by threaded fasteners, and the problem of the jaws becoming "cocked" or otherwise misaligned with their jaw mounting structures may result in damage to the jaws and/or to workpieces being clamped by the jaws.

SUMMARY OF THE INVENTION

The present invention addresses this problem and provides a simple and inexpensive system for removably mounting and accurately positioning jaws on supporting jaw structures of vises, and is particularly well adapted for use on vises of the type described in the referenced Hydraulic Vise Patent.

In accordance with the present invention, a pair of jaws are provided for mounting on jaw structures of a vise. Each of the jaw structures defines a jaw mounting surface. The jaw mounting surfaces face toward each other. Each of the jaws abuttingly engages a separate one of the jaw mounting surfaces. Interfitting formations are provided on each jaw and its associated jaw mounting surface for removably mounting the jaw on its associated jaw mounting surface and for accurately positioning each jaw relative to its associated jaw structure.

In preferred practice, the interfitting formations are of dovetail configuration and include undercut dovetail slots into which undercut dovetail projections are interfitted. The dovetail slots and projections are preferably tapered along their lengths to draw the jaws into tight-fitting engagement with their supporting jaw structures while, at the same time, serving to accurately position and orient the jaws relative to their supporting jaw structures.

The jaw mounting system of the present invention is preferably utilized in conjunction with a fluid-operated vise of the type described in the referenced Hydraulic Vise Patent. The vise described in the Hydraulic Vise Patent includes an elongate base structure having a top surface. An undercut groove extends substantially the full length of the top surface and opens through the top surface. First and second modular jaw structures are supported on the top surface and are movably positionable along the top surface. One of the jaw structures has a fluid-operated component which is movable toward and away from the other of the jaw structures.

Downwardly facing elongate grooves are formed in bottom portions of the first and second jaw structures. The downwardly facing grooves overlie and communicate along their lengths along with the undercut groove. First and second elongate key members are positioned in the communicating grooves. Each of the key members has a lower portion matingly received in the undercut groove, and an upper portion matingly received in a separate one of the downwardly facing grooves. The key members serve a first function of maintaining proper alignment of the jaw and base structures as the first and second jaw structures are positioned and secured in place along the length of the top surface. Key members also form part of first and second clamping systems for releasably retaining the first and second jaw structures in place at selected positions along the top surface.

The jaw structure which has the fluid-operated movable component also has a stationary component. The first clamping system is operable to releasably retain the stationary component at selected positions along the length of the top surface. A fluid-operated actuator system preferably includes a pair of fluid-operated cylinders. The cylinders have relatively movable body and piston portions extending in sets of aligned holes formed in the jaw structure components. Each of the body portions is positioned in a separate hole formed in the stationary component, and is secured to the stationary component. Each of the piston portions extends into a separate hole formed in the movable component, and is operably connected to the movable component. Fluid supply passages are provided in the stationary component for communicating the fluid-operated cylinders with a source of pressurized fluid.

The biasing system preferably comprises a pair of biasing devices, each including a headed pin and a compression coil spring. The headed end of each pin is positioned in a separate hole formed in the stationary component, and is movable axially within such hole. The other end of each pin is positioned in a separate hole formed in the movable component, and is secured to the movable component. The compression coil springs operate on the headed ends of the pins and are carried in the holes formed in the stationary component.

A shield extends over outer surface portions of the stationary and movable components for shielding the open space between the movable and stationary components from the entry of shavings and the like when the components have moved apart.

The base structure preferably has a pair of parallel, elongate sides and a pair of parallel ends. The sides and ends cooperate to define a base structure of substantially rectangular configuration. One of the sides and one of the ends are provided with a groove formation. The other side and the other end are provided with a projecting formation. The projecting formation has a configuration adapted to be matingly received within the groove formation, whereby the projecting formation of one base structure may be received within the groove formation of an identical base structure to permit interlocked, side-by-side and/or end-to-end positioning of a plurality of fluid-operated vises of the type described.

Proper alignment of the relatively movable jaw structures and the base structure is provided at all times by the elongate key members. The key members have essentially "gull-shaped" cross sections defined, in part, by inclined surfaces which are matingly engageable with correspondingly inclined surfaces provided in the undercut groove. The key members perform guiding and alignment functions, and participate in the releasable clamping of the jaw structures in place along the length of the base structure.

The simple and inexpensive jaw mounting system of the present invention can be fabricated with ease whereby a large number of specially configured jaws can be provided relatively inexpensively for use with a particular vise unit. The tapered character of the interfitting dovetail formations utilized in the preferred practice of the jaw mounting system assures that, as the jaws are brought into proper position relative to their supporting jaw structures, the jaws are drawn into tight-fitting engagement with their supporting jaw structures and are accurately positioned and oriented relative to their supporting jaw structures.

Where the jaw mounting system of the present invention is used in conjunction with the vise structure described in the referenced Hydraulic Vise Patent, a simple and compact modular vise construction is provided which features a reliable, lightweight, inexpensive vise system of highly versatile character which can be utilized in a wide variety of production operations to support workpieces for machining. None of the vise components are orientation-sensitive, and vises embodying the preferred practice of the present invention can therefore be employed interchangeably in vertical, horizontal and inclined attitudes.

It is an object of the present invention to provide a novel and improved jaw mounting system for a vise.

It is a further object of the present invention to provide a novel and improved jaw mounting system which is particularly well adapted for use with fluid-operated vises of modular construction and of simple, compact design, preferably of the type described in the referenced Hydraulic Vise Patent.

These and other objects and a fuller understanding of the invention described and claimed in the present application may be had by referring to the following description and claims taken in conjunction with the accompanying drawings.

DESCRIPTION OF THE PREFERRED EMBODIMENT

Figures 1, 2:
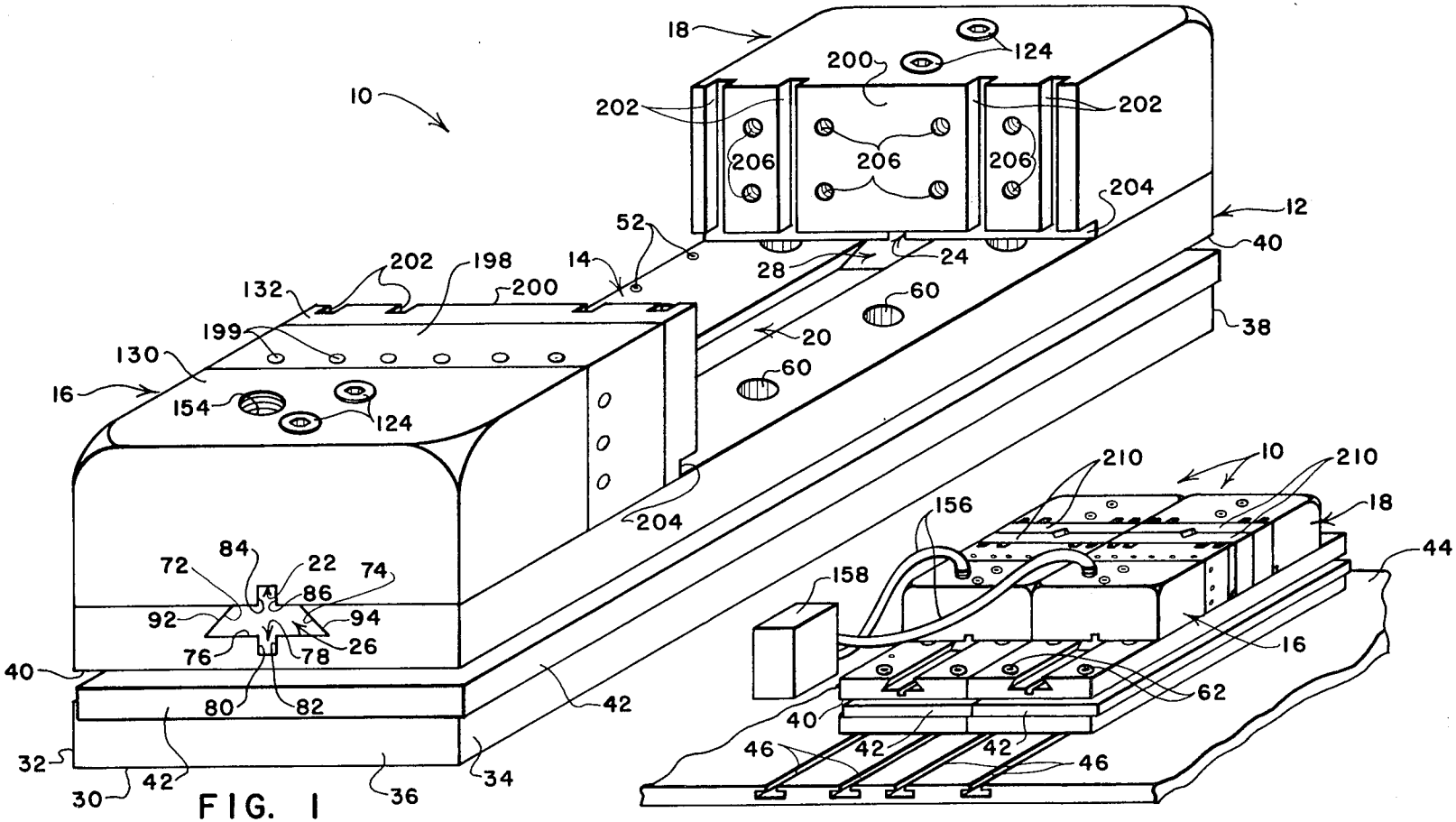
FIG. 1 is a perspective view of a fluid-operated vise of the type utilized in the preferred practice of the present invention.
FIG. 2 is a perspective view of a pair of fluid-operated vises of the type shown in FIG. 1, the vises being positioned in side-by-side relationship atop a conventional work table and being provided with suitable jaws for gripping workpieces to be machined.
Figure 3:
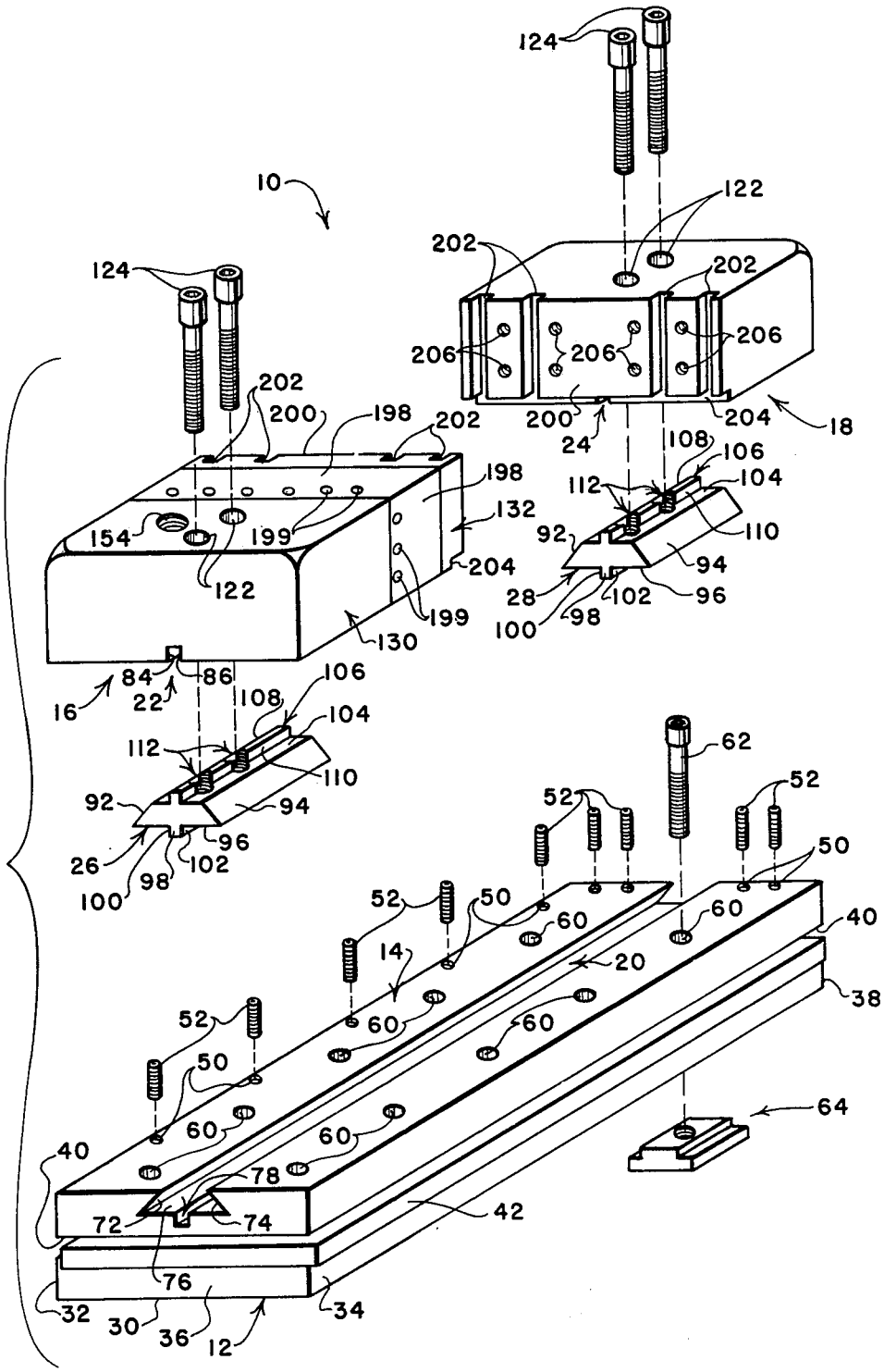
FIG. 3 is an exploded perspective view of the vise of FIG. 1.

Referring to FIGS. 1 and 3, a fluid-operated vise of the basic type utilized in conjunction with the preferred practice of the present invention is indicated generally by the numeral 10. The vise 10 is of the type described in the referenced Hydraulic Vise Patent. The vise 10 includes an elongate base structure 12 having a generally rectangular top surface 14, and a pair of jaw structures 16, 18 supported on and movable along the top surface 14.

As will be explained in greater detail, an undercut groove 20 extends along the length of the base structure 12 and opens through the top surface 14. Downwardly facing grooves 22, 24 are provided in the jaw structures 16, 18 and communicate with the undercut groove 20. A first key member 26 is positioned in the communicating grooves 20, 22, and a second key member 28 is positioned in the communicating grooves 20, 24. The key members 26, 28 have "gull-shaped" cross sections, lower portions of which are matingly received in the undercut groove 20 and upper portions of which are matingly received in the downwardly facing grooves 22, 24. The key members 26, 28 serve a first function of maintaining alignment of the relatively movable structures 12, 16, 18. The key members 26, 28 also form parts of a pair of clamping systems which operate to releasably retain the jaw structures 16, 18 at selected positions along the top surface 12.

The base structure 16 has a planar bottom surface 30 which parallels the plane of the top surface 14. A pair of side surfaces 32, 34 and a pair of end surfaces 36, 38 interconnect the top and bottom surfaces 14, 30. The side surfaces 32, 34 extend in parallel planes which perpendicularly intersect the planes of the top and bottom surfaces 14, 30, and which are located at equal distances from, and on opposite sides of, the undercut groove 20. The end surfaces 36, 38 extend in parallel planes which perpendicularly intersect the planes of the top, bottom and side surfaces 14, 30, 32, 34.

A groove 40 of substantially rectangular cross section is formed in the side and end surfaces 32, 38. A projecting formation 42 of substantially rectangular cross section is formed on the side and end surfaces 34, 36. The projecting formation 42 is configured such that it can be matingly received within a groove 40 on another base structure 12 to permit interlocked, end-to-end, or side-by-side positioning of a pair of vises 10, as is illustrated in FIG. 2. In FIG. 2, a pair of the vises 10 are positioned side-by-side on a conventional work table 44 with the lengths of the vises 10 paralleling conventional T-shaped slots 46 formed in the work table 44.

Referring to FIG. 3, a plurality of threaded holes 50 are formed in the base structure 12 and open through the top surface 14 near the side and end surfaces 32, 38. Bottom ends of the threaded holes 50 open into the groove 40. A plurality of set screws 52 are threaded into the holes 50 and are utilized to effect clamping engagement with such projection formations 42 as may be positioned in the groove 40 when one or more of the vises 10 are positioned in interlocking, end-to-end, and/or side-by-side relationship.

A plurality of mounting holes 60 are provided in the base structure 12 and open through the top and bottom surfaces 14, 30. The holes 60 take the form of stepped bores, each having a larger diameter near the top surface 14 than near the bottom surface 30. The holes 60 are configured to receive socket head cap screws, one of which is indicated by the numeral 62 in FIG. 3. Lower portions of the cap screws 62 depend from the bottom ends of the holes 60 for threading into conventional T-shaped clamping blocks, one of which is indicated by the numeral 64 in FIG. 3. As is well known to those skilled in the art, clamping blocks of the type designated by the numeral 64 are positionable within the conventional T-slots 46 illustrated in FIG. 2, and the socket head cap screws 62 may be threaded into the clamping blocks 64 to hold the vises 10 in a position atop the conventional work table 44, or atop a suitable conventional subplate.

The undercut groove 20 has a pair of inclined sidewalls 72, 74 and an upwardly facing bottom wall 76. The bottom wall 76 extends in a plane paralleling the plane of the top surface 14. A slot 78 opens upwardly through the bottom wall 76. The slot 78 has a substantially rectangular cross section, defined, in part, by sidewalls 80, 82 which parallel the planes of the side surfaces 32, 34. The sidewalls 72, 74 are inclined at equal angles to the plane of the top surface 14, preferably at angles of about 45 degrees, and define undercut surfaces against which the key members 26, 28 may be clamped to releasably retain the jaw structures 16, 18 in place along the top surface 14.

The downwardly facing grooves 22, 24 are of identical, rectangular, cross section, each having a pair of sidewalls 84, 86. The sidewalls 84, 86 extend in planes which parallel the planes of the side surfaces 32, 34.

The key members 26, 28 are substantially identical. Each has a pair of inclined surfaces 92, 94, a bottom surface 96, and a bottom projection 98 with sidewalls 100, 102. Each has an upwardly facing surface 104 and an upwardly extending projection 106 having sidewalls 108, 110. Each is provided with a pair of spaced, threaded holes 112. The axes of the holes 112 parallel each other and extend perpendicularly to the plane of the upwardly facing surface 104.

Lower portions of the key members 26, 28 are slidably carried in the undercut groove 20. The upwardly projecting portions 106 are slidably received in the downwardly facing grooves 22, 24. The sidewalls 100, 102 matingly engage the sidewalls 80, 82 to maintain accurate alignment of the key members 26, 28 with the base structure 12. The sidewalls 108, 110 matingly engage the sidewalls 84, 86 to maintain accurate alignment of the jaw structures 16, 18 with the key members 26, 28 and with the base structure 12.

Each of the jaw structures 16, 18 has a pair of spaced bores 122 formed therethrough. The bores 122 align with the axes of the threaded holes 112 and are of stepped configuration, each having a larger diameter near its upper end than near its lower end. The bores 122 are configured to receive socket head cap screws 124. Lower portions of the cap screws 124 depend from the bottom ends of the bores and are threaded into the holes 112. When the cap screws 124 are tightened into the holes 112, the key members 26, 28 are drawn upwardly, clamping the inclined surfaces 92, 94 into wedging frictional engagement with the inclined sidewalls 72, 74 to retain the jaw structures 16, 18 securely in place relative to the base structure 12. The mating engagement between the sidewalls 100, 102 and 80, 82, and between the sidewalls 108, 110 and 84, 86 maintains proper alignment of the base and jaw structures 12, 16, 18 regardless of whether the cap screws 124 are tightened to effect clamping of the jaw structures 16, 18 against base structure 12, or whether the cap screws 124 are sufficiently loose to permit the jaw structures 16, 18 to move along the top surface 14.

Figure 5:
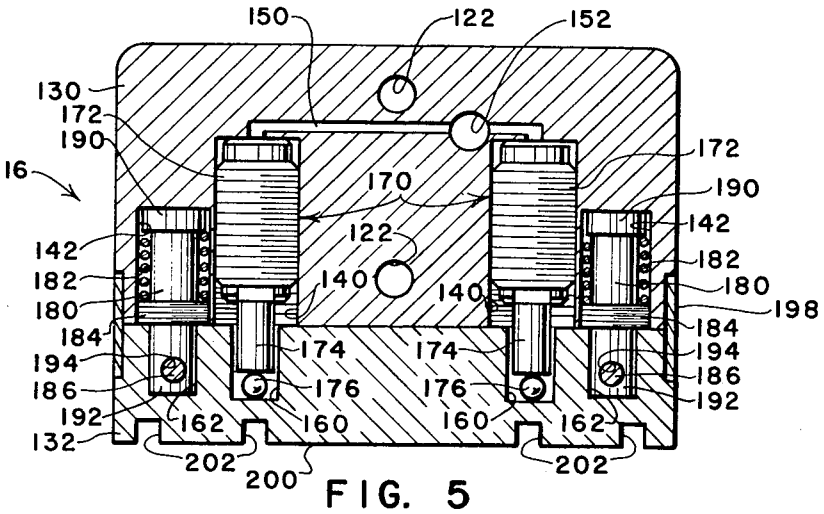
FIG. 5 is a sectional view as seen substantially from planes indicated by a broken line 5—5 in FIG. 4.
Figure 4:
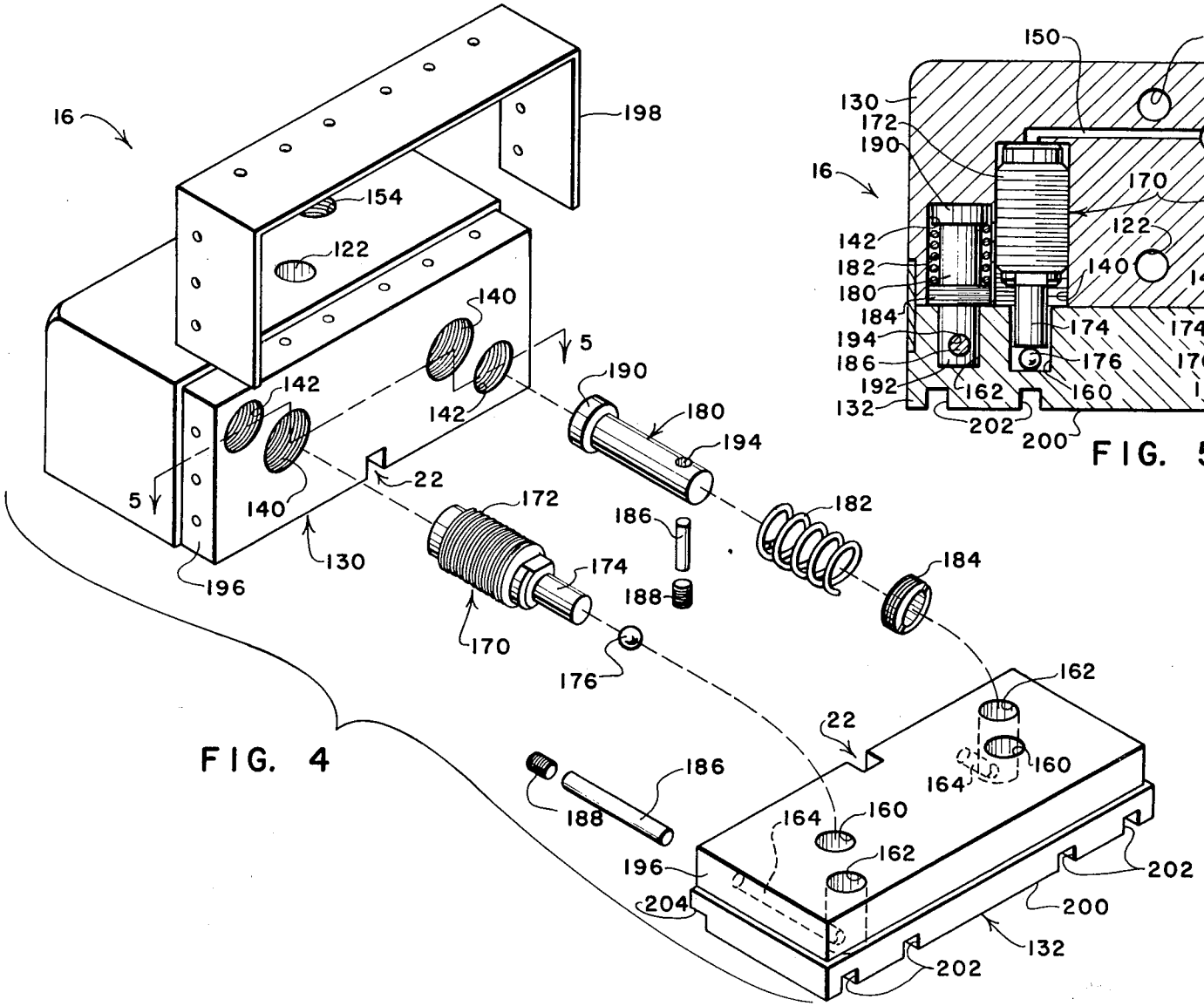
FIG. 4 is an exploded perspective view of portions of one of the modular jaw structures utilized in the vise of FIG. 1.

Referring to FIGS. 4 and 5, the jaw structure 16 includes a pair of relatively movable components 130, 132. The component 130 will be referred to as the stationary component since it can be releasably secured to the base structure 12 by tightening the cap screws 124 it carries. The component 132 will be referred to as the movable component since it is movable relative to the stationary component 130 when the stationary component is clamped in place on the base structure 12.

The stationary component 130 is provided with a pair of relatively large diameter threaded bores 140, and a pair of relatively smaller diameter threaded bores 142. The larger bores 140 are positioned at equal distances from and on opposite sides of the downwardly facing groove 22. The smaller bores 142 are located in a substantially diagonal relationship on opposite sides of groove 22. The axes of the bores 140, 142 parallel each other and parallel the length of the groove 22.

First and second passages 150, 152 are formed in the stationary component 130 for communicating the bores 140 with a source of pressurized fluid. The first passage 150 interconnects the bores 140. The second passage 152 communicates with the first passage 150 and has a threaded upper end 154 opening through the top surface of the stationary component 130. As is illustrated in FIG. 2, a suitable flexible supply conduit 156 may be threaded into the threaded end opening 154 to connect the second passage 152 with a suitable source of pressurized fluid, as indicated generally by the numeral 158.

The movable component 132 is provided with a first pair of bores 160 which align with the bores 140, and a second pair of bores 162 which align with the bores 142. A pair of holes 164 are formed in the movable component 132 and extend from the bores 162 to the bottom face of the component 132.

A fluid-operated actuator system is interposed between the components 130, 132, and includes a pair of conventional fluid-operated cylinders 170. The cylinders 170 are preferably of the type sold by Jergens, Inc., 19520 Nottingham Road, Cleveland, Ohio 44110, under the Part No. 61514. The cylinders 170 have threaded body portions 172 which are threaded into sealing engagement with the bores 140, and have piston portions 174 which extend loosely into the bores 160. A pair of balls 176 are interposed between the ends of the piston portions 174 and the closed ends of the bores 160 to assure that no transverse forces are applied to the movable component 132 by the piston portions 174. When pressurized fluid is supplied to the cylinders 170 through the passages 150, 152, the piston portions 174 are caused to extend relative to the body portions 172, thereby causing the movable component 132 to move away from the stationary component along a path toward the jaw structure 18, as guided by the mating engagement of the key member projection 106 in the movable component groove 22. When the supply of pressurized fluid is diminished, the piston portions 174 retract into the body portions 172 under the influence of springs provided within the cylinders 170. The cylinders 170 preferably have a piston stroke of about three-sixteenths inch.

A biasing system is interposed between the components 130, 132 to assure that the movable component 132 returns to a position adjacent the stationary component 130 as the piston portions 174 retract. The biasing system includes a pair of headed pins 180, a pair of compression coil springs 182, a pair of threaded collars 184, a pair of anchor pins 186, and a pair of set screws 188. The headed pins 180 have enlarged diameter headed ends 190 and smaller diameter opposite ends 192. Holes 194 are formed through the opposite ends 192. The headed ends 190 are carried loosely within the bores 142. The threaded collars 184 are threaded into the bores 142. The pins 180 extend through the collars 184. The springs 182 are interposed between the headed ends 190 and the collars 184 to bias the pins 180 into the bores 142. The opposite ends 192 extend into the bores 162. The anchor pins 186 extend through the holes 164, 194 to connect the headed pins 180 to the movable component 132 for movement therewith. The set screws 188 are threaded into lower ends of the holes 164 to hold the anchor pins 186 in place. By this arrangement, the compression coil springs 182 operate to bias the movable component 132 toward the stationary component 130.

The components 130, 132 have adjacent peripheral portions 196 of slightly reduced cross section. A U-shaped shield 198 is positioned about the portions 196 and is secured to the stationary component 130 by suitable fasteners such as blind rivets, indicated by the numeral 199 in FIG. 3.

The jaw structure 18 is preferably of one-piece construction. The movable component 130 and the jaw structure 18 preferably have substantially identical mounting faces 200 which extend in parallel planes facing toward each other. A plurality of vertically extending coolant grooves 202 are formed in each of the faces 200. Horizontally extending coolant grooves 204 are formed at the bases of the faces 200. Threaded holes 206 are provided in the faces 200 for the mounting of such jaws as a machinist may design to grip a particular type of workpiece. Typical jaws that may be provided by a machinist are indicated by the numeral 210 in FIG. 2.

In preferred practice the major elements of the vise 10, particularly the base and jaw structures 12, 16, 18, are formed from a relatively lightweight aluminum alloy such as 2024-T351. All exposed surfaces are preferably provided with a polytetrafluroethylene coat over an anodized finish to give maximum protection against machining and cutting fluids, and to enhance low-friction adjustability of the relatively movable modular structures.

The pressurized fluid source 158 is preferably of the air-powered hydraulic type such as are sold by Jergins, Inc. under Model Nos. 61761 and 61762. Substantially any desired number of vises 10 can be operated using a single source 158. By selecting a suitable source, fluid having a pressure within the range of 0–2000 psi can be provided to the cylinders 170 to provide suitable clamping pressure for retaining workpieces between the jaws 210.

Figure 6:
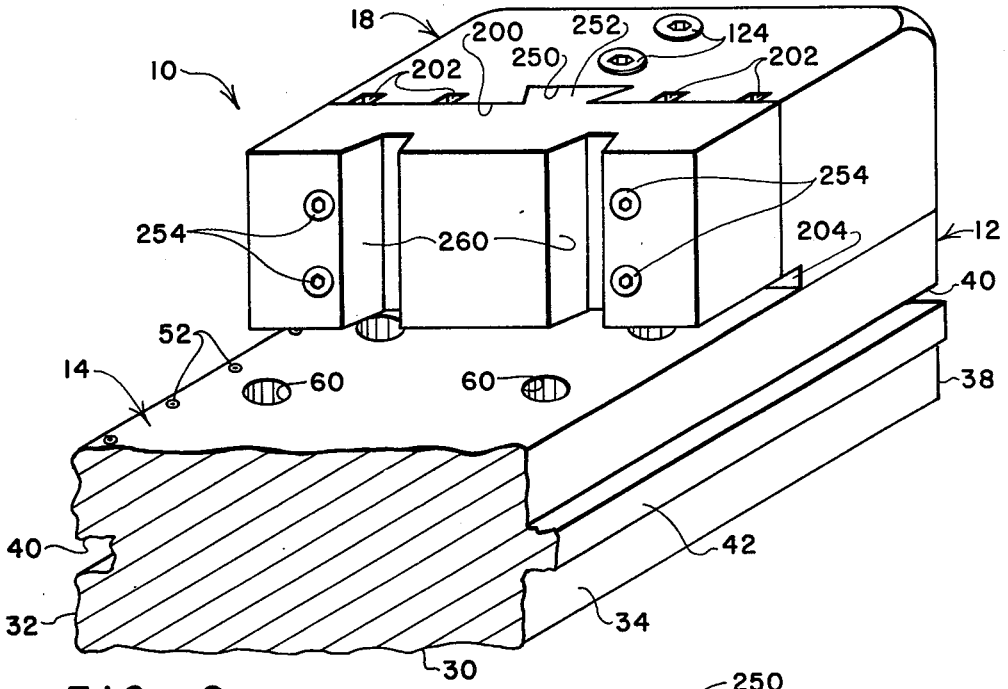
FIG. 6 is a perspective view of a portion of the fluid-operated vise of FIG. 1 showing one of the jaws mounted on one of the jaw structures utilizing the jaw mounting system of the present invention.
Figure 7:
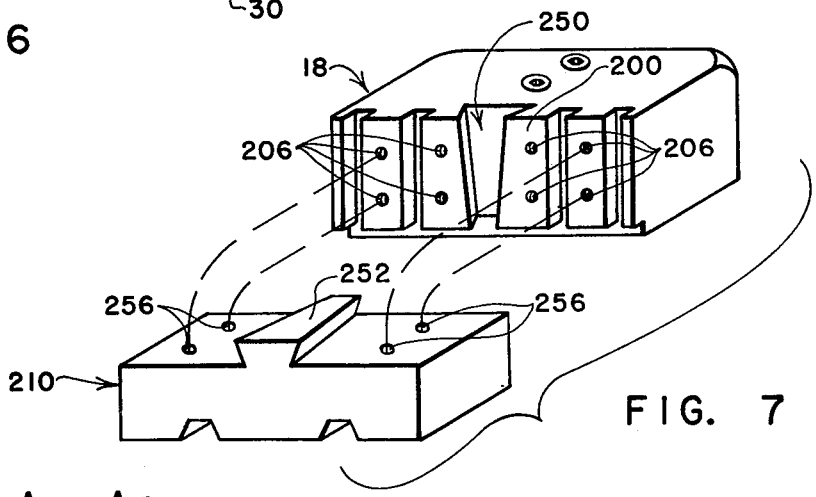
FIG. 7 is an exploded perspective view with the jaw and jaw structure shown in FIG. 6 separated to show features of the jaw mounting system provided for interconnecting these components; and, FIG. 8 is an enlarged side elevational view of a portion of the jaw mounting surface of the jaw structure of FIGS. 6 and 7.
Figure 8:
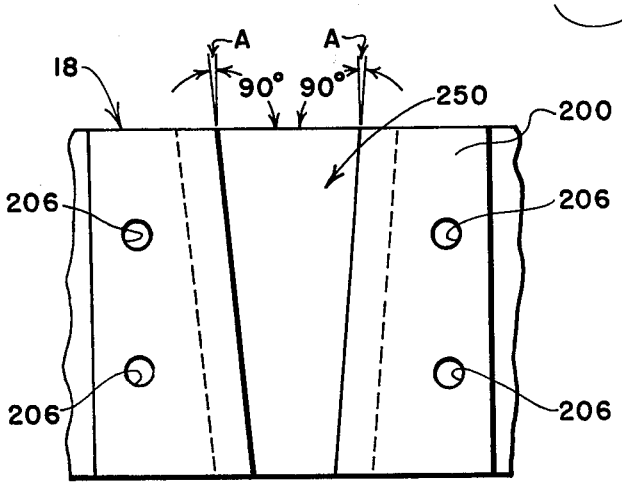

In accordance with the present invention, the jaws 210 are mounted on the mounting faces 200 of the jaw structures 16, 18 utilizing a system shown only in FIGS. 6–8. Inasmuch as the mounting systems utilized for each of the jaws 210 are identical, only the mounting system associated with the jaw structure 18 will be described.

Referring to FIGS. 6–8, the mounting face 200 of the jaw structure 18 is provided with a forwardly-facing undercut groove 250 of dovetail cross section. The jaw 210 is provided with a rearwardly-facing undercut projection 252 of dovetail cross section. The groove 250 and the projection 252 are configured to snugly interfit so as to not only provide a secure means of interconnecting the jaw 210 with the jaw structure 18, but also to provide a system of accurately positioning and orienting the jaw 210 relative to the jaw structure 18.

In preferred practice, the sides of the groove 250 and the sides of the projection 252 are tapered from top to bottom along their lengths. The upper ends of the groove and the projection 250, 252 are of greater width than are the lower ends, this feature being best illustrated in FIG. 8. The angles at which the sides of the groove and projection 250, 252 are inclined from the vertical are indicated in FIG. 8 by the dimension A. In preferred practice the dimension A is within the range of about 3 to 12 degrees. The most preferred angle for dimension A is about 5 degrees.

The jaw 210 is installed on the jaw structure 18 by inserting the lower end of the projection 252 into the upper end of the groove 250, and by moving the jaw 210 downwardly toward its mounted position shown in FIG. 6. The tapered groove and projection 250, 252 are machined and configured such that they operate to tightly clamp the jaw 210 against the mounting face 200 when the jaw 210 is in its mounted position, shown in FIG. 6. Once the jaw 210 has reached its mounted position, it may be secured in place by threaded fasteners 254. The fasteners 254 extend through holes 256 in the jaw 210, and are threaded into the mounting holes 206 in the jaw structure 18.

Appropriate workpiece receiving formations such as grooves 260 may be machined in the jaws 210 as required by a particular application. Since different types of workpiece receiving formations are required for different applications, the operator will normally have a number of sets of specially configured jaws 210 on hand. The described jaw mounting system provides a simple and expedient system for removably mounting the jaws 210 on the jaw structures 16, 18 and for properly positioning and orienting the jaws 210 relative to the jaw structures 16, 18 during mounting of the jaws.

The described mounting system not only prevents "cocking" and side-to-side misalignment of the jaws 210 relative to the jaw structures 16, 18, but also prevents the jaws 210 from being inadvertently installed upside down on the jaw structures 16, 18. The tapered groove and projection 250, 252 will not interfit properly if an attempt is made to install one of the jaws 210 upside down.

As will be apparent from the foregoing description, the present invention provides a simple and expedient system for removably mounting and accurately positioning jaws on supporting jaw structures. The invention is particularly well adapted for use on simple, lightweight, modular fluid-operated vises of the type described in the Hydraulic Vise Patent. Where the jaw mounting system of the present invention is utilized in conjunction with the system described in the Hydraulic Vise Patent, the result is a particularly versatile vise system of modular character which permits a number of vise units to be positioned side-by-side and/or end-to-end as may be required for a particular application.

While certain of the components of the vise 10 have been described utilizing such terms as "top", "bottom", "upwardly facing", "downwardly facing", and the like, it will be appreciated that vises embodying the preferred practice of the present invention are not orientation-sensitive and can be positioned in vertical, horizontal and inclined attitudes as may be required by a particular application. Accordingly, these terms are used simply as a matter of convenience to facilitate describing the construction and relationship of the components, and shall not be interpreted as limiting vises embodying the spirit of the invention to use in a particular orientation.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A fluid-operated vise, comprising:

(a) an elongate base structure having a top surface and an undercut groove including inclined surface portions, the undercut groove extending substantially the full length of and opening through the top surface;

(b) first and second jaw structures supported on the top surface and being movably positionable therealong for gripping a workpiece therebetween;

(c) first and second downwardly facing elongate grooves provided, respectively, in bottom portions of the first and second jaw structures the first and second downwardly facing grooves being of substantially identical cross section and communicating along their lengths with the undercut groove as the first and second jaw means are positioned along the length of the top surface;

(d) first and second elongate key members each having lower cross sectional portions configured to correspond to the undercut cross section of the undercut groove and being positioned therein, and each having upper cross sectional portions configured to correspond to the cross section of the downwardly facing grooves and being positioned therein, whereby the key members maintain alignment of the first and second jaw structures and the base structure as the jaw structures are positioned along the length of the top surface;

(e) first and second clamping means for clamping the first and second key members into engagement with the inclined surface portions to releasably retain the first and second jaw structures in place at selected positions along the length of the top surface;

(f) one of the jaw structures defining a first jaw mounting surface facing toward the other of the jaw structures;

(g) the other of the jaw structures including:

(i) a first component operably engaged by the first clamping means and adapted to be secured by the first clamping means at a first selected position along the length of the top surface;

(ii) a second component movably connected to the first component for relative movement in directions toward and away from said one jaw structure;

(iii) fluid-operated actuator means interposed between the first and second components for moving the second component relative to the first component in a direction toward said one jaw structure; and, (iv) biasing means interposed between the first and second components for biasing the second component toward the first component in a direction away from said first jaw structure;

(h) the second component defining a second jaw mounting surface facing toward the first jaw mounting surface;

(i) first and second jaw means carried, respectively, by the first and second jaw structures and being configured to clampingly engage workpiece means therebetween when the second component is moved toward said first jaw structure under the influence of the fluid-operated actuator;

(j) the first jaw means abuttingly engaging the first jaw mounting surface, and the second jaw means abuttingly engaging the second jaw mounting surface; and, (k) interfitting formation means being provided on the first jaw means and the first jaw mounting surface, and on the second jaw means and the second jaw mounting surface, for releasably mounting the jaw means on their respective jaw mounting surfaces and for accurately positioning the jaw means relative to their respective jaw mounting surfaces.

2. The fluid-operated vise of claim 1 wherein the interfitting formation means include undercut grooves and undercut projections.

3. The fluid-operated vise of claim 2 wherein the undercut grooves and the undercut projections are of dovetail configuration.

4. The fluid-operated vise of claim 3 wherein the undercut grooves and the undercut projections are elongate and taper along their lengths to effect clamping of the jaw means into tight-fitting engagement with the jaw structures as the jaw means are mounted on the jaw structures.

5. The fluid-operated vise of claim 4 wherein the tapered character of the grooves and projections is provided by opposite sides of the grooves and projections being non-parallel.

6. The fluid-operated vise of claim 5 wherein the angles of inclination of the sides of the grooves and projections, as measured from lines paralleling the lengths of the grooves and projections, are within the range of about 3 to 12 degrees.

7. The fluid-operated vise of claim 6 wherein the angles of inclination are about 5 degrees.

8. A fluid-operated vise, comprising:

(a) an elongate base structure having a top surface and an upwardly facing groove extending substantially the full length of and opening through the top surface;

(b) first and second jaw structures supported on the top surface and being movably positionable therealong for gripping a workpiece therebetween;

(c) first and second downwardly facing elongate grooves provided, respectively, in bottom portions of the first and second jaw structures, the first and second downwardly facing grooves being of substantially identical cross section and communicating along their lengths with the upwardly facing groove as the first and second jaw structures are positioned along the length of the top surface;

(d) first and second elongate key members each having lower cross sectional portions configured to correspond to the cross section of the upwardly facing groove and being positioned therein, and each having upper cross sectional portions configured to correspond to the cross section of the downwardly facing grooves and being positioned therein, whereby the key members maintain alignment of the first and second jaw structures and the base structure as the jaw structures are positioned along the length of the top surface;

(e) first and second clamping means for clamping the first and second jaw structures in place at selected positions along the length of the top surface;

(f) one of the jaw structures defining a first jaw mounting surface facing toward the other of the jaw structures, the one jaw structure being operably engaged by the first clamping means and being adapted to be secured by the first clamping means at a first selected position along the length of the top surface;

(g) the other of the jaw structures including:

(i) a first component operably engaged by the second clamping means and adapted to be secured by the second clamping means at a second selected position along the length of the top surface;

(ii) a second component movably connected to the first component for relative movement in directions toward and away from said one jaw structure;

(iii) fluid-operated actuator means interposed between the first and second components for moving the second component relative to the first component in a direction toward said one jaw structure; and, (iv) biasing means interposed between the first and second components for biasing the second component toward the first component in a direction away from said first jaw structure;

(h) the second component defining a second jaw mounting surface facing toward the first jaw mounting surface;

(i) first and second jaw means carried, respectively, on the first and second jaw structures and being configured to clampingly engage workpiece means therebetween when the second component is moved toward said first jaw structure under the influence of the fluid-operated actuator;

(j) the first jaw means abuttingly engaging the first jaw mounting surface, and the second jaw means abuttingly engaging the second jaw mounting surface;

(k) a first set of interfitting formation means being provided on the first jaw means and the first jaw mounting surface, and a second set of interfitting formation means being provided on the second jaw means and the second jaw mounting surface, the sets of interfitting formation means operating to releasably mount the jaw means on their respective jaw mounting surfaces and to accurately position the jaw means relative to their respective jaw mounting surfaces; and, (l) each set of interfitting formation means including:

(i) an elongate undercut groove formed in the mounting surface of the associated jaw structure; and, (ii) an elongate projection formed on a back face of the associated jaw means.

9. The jaw mounting system of claim 8 wherein the undercut groove and undercut projection are of dovetail configuration.

10. The jaw mounting system of claim 9 wherein the undercut groove and undercut projection taper along their lengths to effect clamping of each of the jaw means into tight-fitting engagement with its associated jaw structure as the jaw means is mounted its associated jaw structure.

11. The jaw mounting system of claim 10 wherein the tapered character of the groove and projection is provided by opposite sides of the groove and projection being nonparallel.

12. The jaw mounting system of claim 11 wherein the angles of inclination of the sides of the groove and projection, as measured from lines paralleling the lengths of the groove and projection, are within the range of about 3 to 12 degrees.

13. The jaw mounting system of claim 12 wherein the angles of inclination are about 5 degrees.

* * * * *